US008328330B2

(12) United States Patent
Goin et al.

(10) Patent No.: US 8,328,330 B2
(45) Date of Patent: Dec. 11, 2012

(54) NOZZLE PLATE FOR IMPROVED POST-BONDING SYMMETRY

(75) Inventors: Richard Louis Goin, Lexington, KY (US); Christopher Elliot Lingle, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 1095 days.

(21) Appl. No.: 12/131,953

(22) Filed: Jun. 3, 2008

(65) Prior Publication Data

US 2009/0295870 A1 Dec. 3, 2009

(51) Int. Cl.
*B41J 2/14* (2006.01)

(52) U.S. Cl. ..... 347/47; 347/65

(58) Field of Classification Search ..... 347/47, 347/65

See application file for complete search history.

(56) References Cited

U.S. PATENT DOCUMENTS

| | | | | | |
|---|---|---|---|---|---|
| 4,894,664 | A * | 1/1990 | Tsung Pan | 347/63 |
| 5,214,449 | A * | 5/1993 | Buhler | 347/65 |
| 5,900,894 | A * | 5/1999 | Koizumi et al. | 347/65 |
| 6,102,516 | A * | 8/2000 | Gibson | 347/19 |
| 6,158,843 | A * | 12/2000 | Murthy et al. | 347/47 |
| 6,283,584 | B1 * | 9/2001 | Powers et al. | 347/65 |
| 6,305,790 | B1 * | 10/2001 | Kawamura et al. | 347/65 |
| 6,310,641 | B1 * | 10/2001 | Mrvos et al. | 347/47 |
| 6,312,112 | B1 * | 11/2001 | Pietrzyk | 347/65 |
| 6,350,018 | B1 * | 2/2002 | Waggoner | 347/65 |
| 6,443,564 | B1 * | 9/2002 | Keil et al. | 347/65 |
| 6,761,435 | B1 * | 7/2004 | Powers | 347/65 |
| 7,101,024 | B2 * | 9/2006 | Lim et al. | 347/62 |
| 7,152,951 | B2 * | 12/2006 | Maher et al. | 347/47 |
| 7,163,278 | B2 * | 1/2007 | Lee et al. | 347/56 |
| 7,188,933 | B2 * | 3/2007 | Silverbrook et al. | 347/54 |
| 7,281,783 | B2 * | 10/2007 | Raman | 347/65 |
| 2002/0005878 | A1 * | 1/2002 | Moon et al. | 347/58 |
| 2002/0118260 | A1 * | 8/2002 | Waggoner et al. | 347/85 |
| 2003/0076388 | A1 * | 4/2003 | Waggoner et al. | 347/85 |
| 2005/0116993 | A1 * | 6/2005 | Silverbrook et al. | 347/54 |
| 2005/0157091 | A1 * | 7/2005 | Hu et al. | 347/65 |

* cited by examiner

*Primary Examiner* — Charlie Peng
*Assistant Examiner* — Peter Radkowski

(57) ABSTRACT

A nozzle plate for bonding to a chip for configuring a printhead of a printing device is disclosed. The chip comprises a plurality of energizing elements. The nozzle plate comprises a substrate layer, an adhesive layer and a plurality of nozzle holes perforated in the substrate layer and the adhesive layer. The each nozzle hole is capable of being associated with an energizing element of the plurality of energizing elements. The each nozzle hole comprises an asymmetric flow-feature configured by ablating at least a portion of a wall of the each nozzle hole prior to bonding the nozzle plate to the chip. The nozzle plate provides a substantially symmetrical flow-feature for the each nozzle hole on bonding to the chip.

12 Claims, 5 Drawing Sheets

NOZZLE PLATE FOR IMPROVED POST-BONDING SYMMETRY

BACKGROUND

1. Field of the Invention

The invention relates generally to printheads in printing devices, and, more particularly, to a nozzle plate for bonding to a chip for configuring a printhead of a printing device.

2. Description of the Related Art

Printing devices commonly referred to as printers, are widely used in offices, in homes and in business enterprises. The printing devices output information displayed on a screen of a data processing device onto a media sheet such as a sheet of paper. The information may be output onto the media sheet by impacting desired information elements, such as characters, onto the media sheet, or alternatively, the printing devices may propel droplets of liquid medium, such as ink, onto the media sheet for outputting the information onto the media sheet. Commonly used printing devices, such as inkjet printers, propel ink droplets onto the media sheet for transferring the information onto the media sheet. The inkjet printers typically use print cartridges having printheads for directing the ink droplets onto the media sheet in patterns corresponding to the information to be printed onto the media sheet.

A typical print cartridge of an inkjet printer includes an ink container and a printhead. The printhead includes a chip and a nozzle plate bonded to the chip. The nozzle plate includes a plurality of nozzle holes. During a printing operation, the printhead is moved relative to the media sheet and the ink droplets are released through nozzle holes of the plurality of nozzle holes for transferring the information onto the media sheet.

Referring now to drawings and more specifically to FIG. 1, a cross-sectional view of a portion of a prior art nozzle plate 10 attached to a chip 12 prior to bonding nozzle plate 10 to chip 12 is depicted. Nozzle plate 10 includes a substrate layer 14 and an adhesive layer 16. Adhesive layer 16 comprises a first surface (not shown) attached to substrate layer 14 and a second surface (not shown) attached to a planarizing layer 18 for attaching nozzle plate 10 to chip 12. Planarizing layer 18 provides a planar surface on chip 12 for attaching nozzle plate 10 to chip 12. A plurality of nozzle holes, such as a nozzle hole 20*a* and a nozzle hole 20*b*, may be perforated into substrate layer 14 and adhesive layer 16. Nozzle holes, such as nozzle hole 20*a* and nozzle hole 20*b*, may hereinafter be collectively referred to as a plurality of nozzle holes 20 (not shown). It will be evident to those skilled in the art that FIG. 1 depicts the cross-sectional view of the portion of nozzle plate 10 and that nozzle plate 10 includes plurality of nozzle holes 20 (not shown) perforated in substrate layer 14 and adhesive layer 16.

Each nozzle hole of plurality of nozzle holes 20 configures an ink flow chamber, such as an ink flow chamber 22*a* and an ink flow chamber 22*b*, for receiving ink from an ink container (not shown). A structural configuration, i.e., configuration of wall, of each ink flow chamber defines a flow-feature for respective nozzle hole for directing the ink towards an opening of the respective nozzle hole. The flow-feature for the each nozzle hole is configured to be substantially symmetrical about a central axis of the each nozzle hole for facilitating movement of ink droplets towards the opening. For instance, the flow-feature associated with nozzle hole 20*a* may be substantially symmetrical about a central axis 24*a* for facilitating movement of the ink droplets towards an opening (not shown) of nozzle hole 20*a*.

Chip 12 includes a plurality of energizing elements such as an energizing element 26*a* and an energizing element 26*b*. Energizing elements, such as energizing element 26*a* and energizing element 26*b*, will hereinafter be collectively referred to as a plurality of energizing elements 26 (not shown). An example of an energizing element of plurality of energizing elements 26 may be a resistive heating element. Chip 12 is attached to nozzle plate 10 prior to bonding chip 12 to nozzle plate 10, such that the each nozzle hole is associated with an energizing element. For instance, nozzle hole 20*a* is associated with energizing element 26*a*, and, nozzle hole 20*b* is associated with energizing element 26*b*.

Prior to attaching nozzle plate 10 to chip 12, nozzle plate 10 may be prestretched, i.e., aligned such that the each nozzle hole of plurality of nozzle holes 20 is configured to align a central axis of the each nozzle hole at a pre-defined distance from a central axis of the energizing element of the plurality of energizing elements associated with the each nozzle hole. On aligning nozzle plate 10 with chip 12, nozzle plate 10 may be bonded to chip 12 using one or more thermal processes such as Thermal Compression Bonding (TCB), bake and the like. Nozzle plate 10 bonded to chip 12 is depicted in FIG. 2.

FIG. 2 depicts a schematic depiction of a cross-sectional view of the portion of prior art nozzle plate 10 bonded to chip 12. Prestretching nozzle plate 10 prior to bonding to chip 12 may substantially align a central axis of the each nozzle hole with a central axis of a corresponding energizing element during the bonding of nozzle plate 10 to chip 12, such that the each nozzle hole may be centered over the corresponding energizing element. For instance, an alignment of central axis 24*a* of nozzle hole 20*a* is substantially aligned with a central axis (not shown) of energizing element 26*a*. During bonding of nozzle plate 10 with chip 12 using thermal processes such as TCB, bake and the like, substrate layer 14 and chip 12 undergo varying levels of expansion. Adhesive layer 16 which is attached to substrate layer 14 at the first surface and attached to chip 12 at the second surface is forced to stretch and conform to the varying levels of expansion, resulting in asymmetrical flow-features for ink flow chambers associated with plurality of nozzle holes 20. For instance, flow-features for ink flow chambers, such as ink flow chamber 22*a* and ink flow chamber 22*b* corresponding to nozzle hole 20*a* and nozzle hole 20*b*, respectively, are asymmetrical respect to respective central axes, on bonding nozzle plate 10 to chip 12.

The asymmetrical flow-features for the each nozzle hole may impact a directionality of ink droplets to be ejected from of plurality of nozzle holes 20. Moreover, asymmetrical flow-features may also result in expanding a swath area, i.e., an area traced on the media sheet by the printhead, during a particular unidirectional scan of a printhead onto the media sheet.

Based on the foregoing, there is a need for compensating for deformation of a nozzle plate during the bonding of the nozzle plate to a chip. Further, there exists a need for configuring a nozzle plate with improved post-bonding symmetry, i.e., substantially symmetrical flow-feature for nozzle holes, subsequent to the bonding of the nozzle plate to the chip. Furthermore, there exists a need to substantially reduce swath area expansion resulting from deformation caused to a nozzle plate during the bonding of the nozzle plate to the chip.

SUMMARY OF THE INVENTION

In view of the foregoing disadvantages inherent in the prior art, the present invention provides an improved nozzle plate for bonding to a chip and improved methods for bonding a nozzle plate and chip.

In one aspect, embodiments of the present invention provide a nozzle plate for bonding to a chip for configuring a printhead of a printing device. The chip comprises a plurality of energizing elements. The nozzle plate comprises a substrate layer, an adhesive layer and a plurality of nozzle holes perforated in the substrate layer and the adhesive layer. The adhesive layer comprises a first surface for attaching to the substrate layer and a second surface capable of bonding to the chip. Each nozzle hole is capable of being associated with an energizing element of the plurality of energizing elements. Each nozzle hole comprises an asymmetric flow-feature configured by ablating at least a portion of a wall of the each nozzle hole prior to bonding the nozzle plate to the chip. The asymmetrical flow-feature for the each nozzle hole, prior to bonding the nozzle plate to the chip, results in a near-symmetrical flow-feature for each nozzle hole once the bonding process has completed.

In another aspect, embodiments of the present invention provide a method for preparing a nozzle plate for bonding to a chip for configuring a printhead of a printing device. The chip comprises a plurality of energizing elements. The nozzle plate includes a plurality of nozzle holes, such that each nozzle hole of the plurality of nozzle holes is capable of being associated with an energizing element of the plurality of energizing elements. The method comprises ablating at least a portion of a wall of each nozzle hole for configuring an asymmetrical flow-feature for the each nozzle hole. The nozzle plate may be disposed on the chip for aligning a central axis of the each nozzle hole at a pre-defined distance from a central axis of the energizing element associated with the each nozzle hole. The asymmetrical flow-feature for each nozzle hole, prior to bonding the nozzle plate to the chip, provides a substantially symmetrical post-bonding process flow-feature.

The substantially symmetrical flow-feature, i.e., improved post-bonding symmetry, for the each nozzle hole provides the desired directionality to the ink droplets ejected from an opening in the each nozzle hole. In an aspect of the present invention, the at least a portion of the wall of the each nozzle hole may be ablated using laser ablation technique with gray-scale mask for configuring the asymmetrical flow-feature for the each nozzle hole. The asymmetrical flow-feature structure of the each nozzle hole in the pre-bonding stage compensates for deformation of a nozzle plate during the bonding of the nozzle plate to the chip and reduces substantially the swath expansion that results from the deformation of the nozzle plate during the bonding process.

BRIEF DESCRIPTION OF THE DRAWINGS

The above-mentioned and other features and advantages of this present invention, and the manner of attaining them, will become more apparent and the present invention will be better understood by reference to the following description of embodiments of the invention taken in conjunction with the accompanying drawings, wherein.

DETAILED DESCRIPTION

Figure 1:
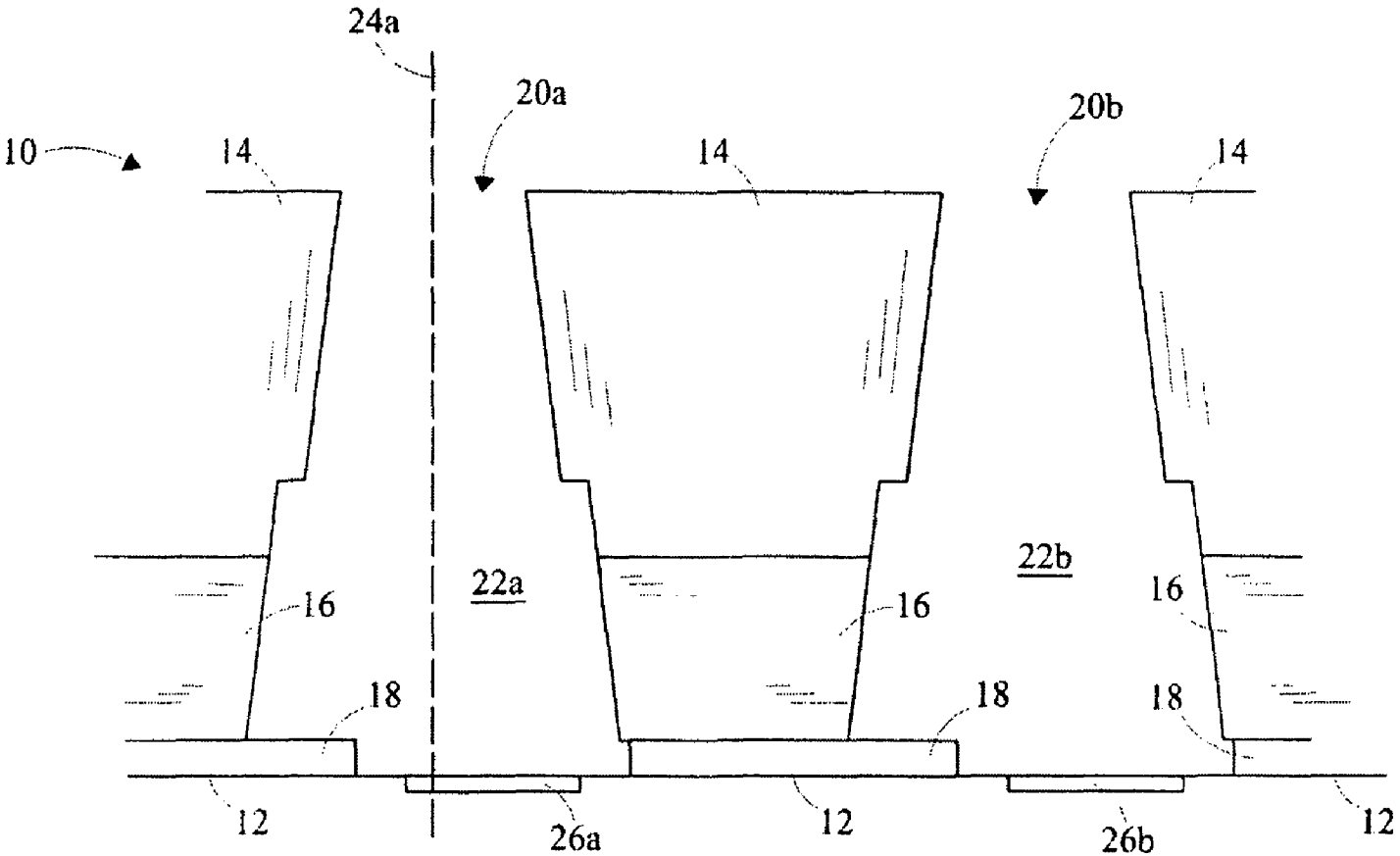
Figure 1 (PRIOR ART)
FIG. 1 is a schematic depiction of a cross-sectional view of a portion of prior art nozzle plate attached to a chip for bonding the nozzle plate to the chip.
Figure 2:
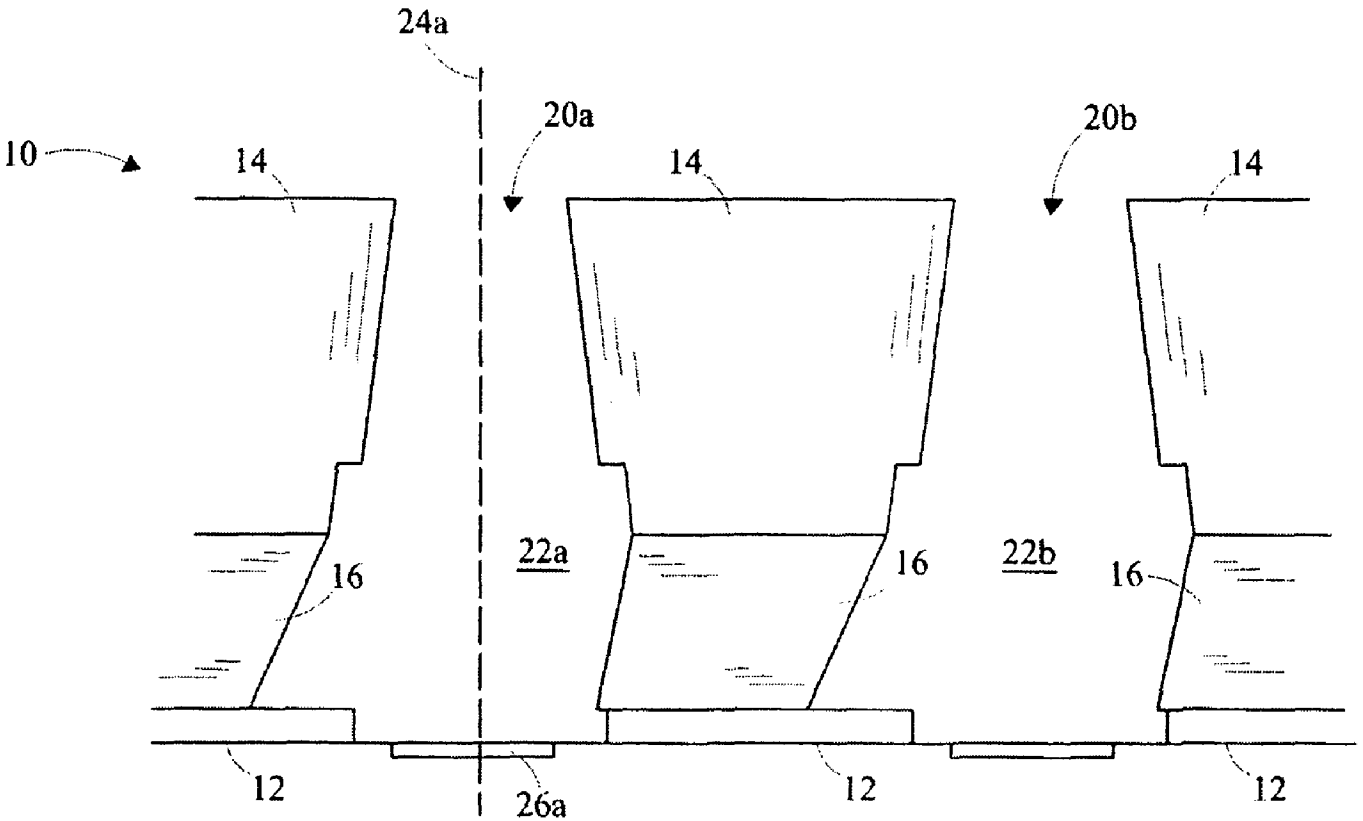
Figure 2 (PRIOR ART)
FIG. 2 is a schematic depiction of a cross-sectional view of a portion of the prior art nozzle plate bonded to the chip.

It is to be understood that the present invention is not limited in its application to the details of construction and the arrangement of components set forth in the following description or illustrated in the drawings. The present invention is capable of other embodiments and of being practiced or of being carried out in various ways. Also, it is to be understood that the phraseology and terminology used herein is for the purpose of description and should not be regarded as limiting. The use of "including," "comprising," Or "having" and variations thereof herein is meant to encompass the items listed thereafter and equivalents thereof as well as additional items.

In addition, it should be understood that embodiments of the present invention include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the present invention may be implemented in software. As such, it should be noted that a plurality of hardware and software-based devices, as well as a plurality of different structural components may be utilized to implement the present invention. Furthermore, and as described in subsequent paragraphs, the specific mechanical configurations illustrated in the drawings are intended to exemplify embodiments of the present invention and that other alternative mechanical configurations are possible.

Some embodiments of the present invention provide an improved nozzle plate for bonding to a chip and new methods for building a nozzle plate that will be bonded to the chip. The chip comprises a plurality of energizing elements. The nozzle plate comprises a substrate layer, an adhesive layer and a plurality of nozzle holes perforated in the substrate layer and the adhesive layer. The adhesive layer comprises a first surface for attaching to the substrate layer and a second surface capable of bonding to the chip. Each nozzle hole of the plurality of nozzle holes comprises an asymmetric flow-feature configured by ablating at least a portion of a wall of the each nozzle hole. Each nozzle hole is capable of being associated with an energizing element of the plurality of energizing elements and configured to align a central axis of the each nozzle hole at a pre-defined distance from a central axis of the energizing element of the plurality of energizing elements. The asymmetrical flow-feature for each nozzle hole, prior to bonding the nozzle plate to the chip, provides a substantially symmetrical flow-feature for the each nozzle hole on bonding to the chip.

Figure 3:
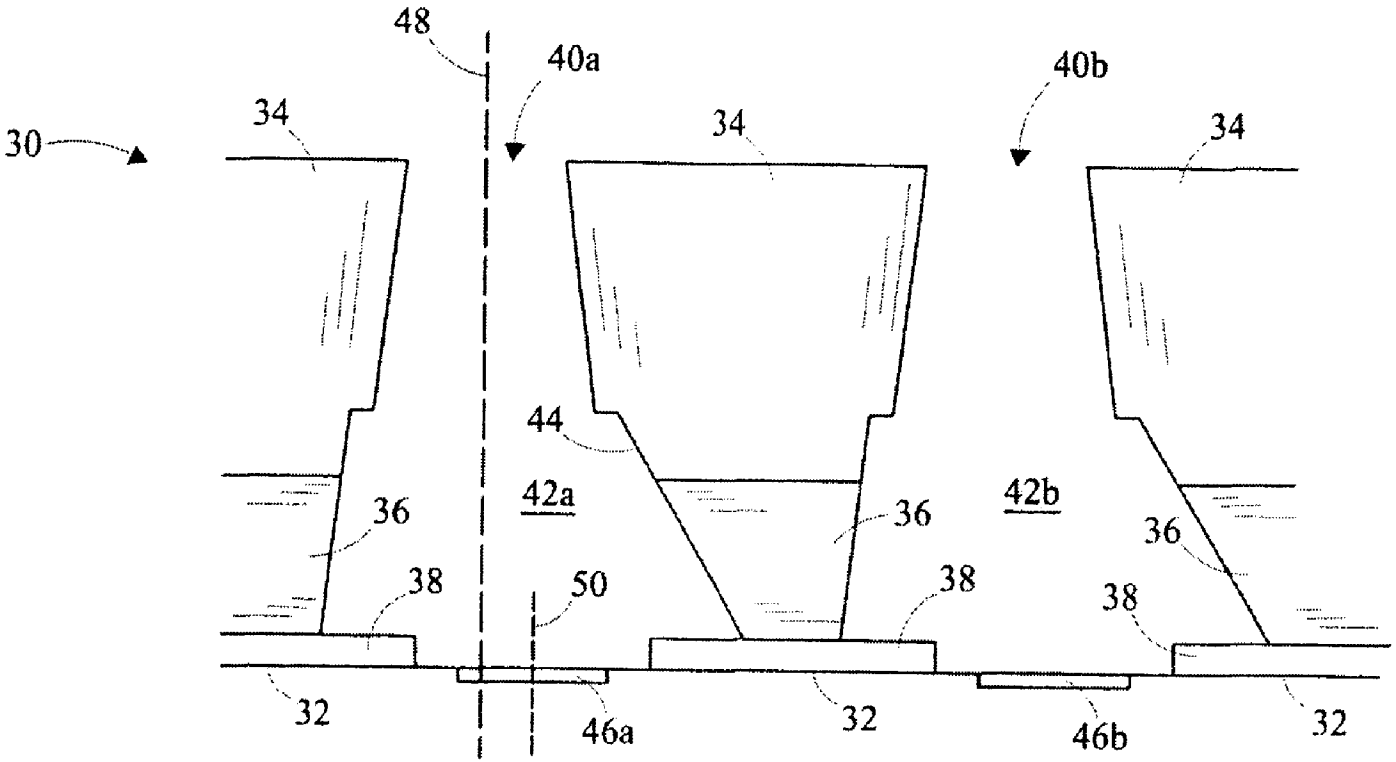
FIG. 3 is a schematic depiction of a cross-sectional view of a portion of a nozzle plate embodying the present invention.

Referring now to FIG. 3, there is shown a schematic depiction of a cross sectional view of a portion of a nozzle plate 30 embodying the present invention. Further, a method of preparing nozzle plate 30 for bonding to a chip 32 may be described with reference to FIG. 3.

Nozzle plate 30 includes a substrate layer 34 and an adhesive layer 36. Adhesive layer 36 comprises a first surface (not shown) for attaching to substrate layer 34 and a second surface (not shown) capable of bonding to chip 32. Adhesive layer 36 may be used to attach nozzle plate 30 to chip 32 prior to bonding nozzle plate 30 to chip 32. A planarizing layer 38 may be used to provide a planar surface on chip 32 for attaching nozzle plate 30 to chip 32. It will be evident to those skilled in the art that substrate layer 34 may be composed of a polymeric material such as a polyimide, a polyester, a fluorocarbon polymer, a polycarbonate and the like. Further, adhesive layer 36 may be composed of phenolic butyral adhesive composite material and such adhesive composite material. In an embodiment of the present invention, chip 32 may be composed of silicon.

A plurality of nozzle holes, such as a nozzle hole 40*a* and a nozzle hole 40*b*, are perforated into substrate layer 34 and adhesive layer 36. Nozzle holes, such as nozzle hole 40*a* and nozzle hole 40*b*, will hereinafter be collectively referred to as a plurality of nozzle holes 40 (not shown). Each nozzle hole of plurality of nozzle holes 40 configures an ink flow chamber, such as ink flow chamber 42*a* and an ink flow chamber 42*b*, for receiving ink from an ink container (not shown). It will be evident to those skilled in the art that the ink may at least be one of a pigment based ink and a dye based ink. Each ink flow chamber is configured at a chip-side of nozzle plate 30 and may be bounded by wall with an increased taper as compared to a wall taper near an opening-side (opposite to the chip-side) of nozzle plate 30. A structural configuration, i.e., configuration of a wall, of the each ink flow chamber defines a 'flow-feature', for a respective nozzle hole, for directing ink towards an opening of the respective nozzle hole. Each nozzle hole of plurality of nozzle holes 40 comprises an asymmetric flow-feature, i.e., asymmetrical structural configuration of walls of an ink flow chamber about a central axis of each nozzle hole. The asymmetric flow-feature for each nozzle hole may be configured by ablating at least a portion of a wall of each nozzle hole, i.e., at least a portion of the wall of an ink flow chamber associated with each nozzle hole. In one embodiment of the present invention, at least a portion of the wall of some or all of the nozzle holes are ablated using laser ablation with a grayscale mask, resulting in an asymmetrical flow-feature structure prior to the nozzle plate being bonded to the heater chip.

The grayscale mask may be used to reduce an intensity of energy directed during the laser ablation towards the portion of the wall, hereinafter referred to as an outboard chamber wall, and further may be used to increase intensity towards a portion of the wall opposite to the outboard chamber wall, hereinafter referred to as an inboard chamber wall, thereby creating increased wall angle at the outboard chamber wall. The increased wall angle at the outboard chamber wall of each ink flow chambers creates an asymmetric flow-feature for each nozzle hole. For instance, for nozzle hole 40*a*, a portion of an outboard chamber wall 44 of ink flow chamber 42*a* may be laser ablated using the grayscale mask for configuring an asymmetrical flow-feature for ink flow chamber 42*a*.

Chip 32 includes a plurality of energizing elements such as an energizing element 46*a* and an energizing element 46*b*. Energizing elements, such as energizing element 46*a* and energizing element 46*b*, will hereinafter be collectively referred to as plurality of energizing elements 46 (not shown). An example of an energizing element may be a heating resistive element. Chip 32 may be attached to nozzle plate 30 prior to bonding chip 32 to nozzle plate 30, such that the each nozzle hole is associated with an energizing element of plurality of energizing elements 46. For instance, nozzle hole 40*a* is associated with energizing element 46*a*, and, nozzle hole 40*b* is associated with energizing element 46*b*. Nozzle plate 30 may be aligned prior to attaching nozzle plate 30 to chip 32 such that a central axis of the each nozzle hole is at a predefined distance from a central axis of a corresponding energizing element. For instance, for nozzle hole 40*a*, central axis 48 may be aligned such that central axis 48 lies at a predefined distance from central axis 50 of energizing element 46*a* associated with nozzle hole 40*a*. In one embodiment of the present invention, the predefined distance may be based on one or more dimensions of nozzle plate 30 such as a pre-bonding length of nozzle plate 30 and an average length of stretched nozzle plate 30 on completion of the bonding.

In some embodiments, the process for using asymmetrical flow-features in a nozzle and an alignment of a nozzle plate 30 such that the central axis of each nozzle hole is at the predefined distance from the central axis of the corresponding energizing element (or heater chip) uses predetermined values (described below) so that the deformation that occurs as the nozzle plate is bonded to the heater chip is compensated for and results in a nozzle plate with a flow feature that is substantially aligned with the center of the heating element. This is explained in more detail below, and is illustrated in FIG. 3A.

Figure 3A:
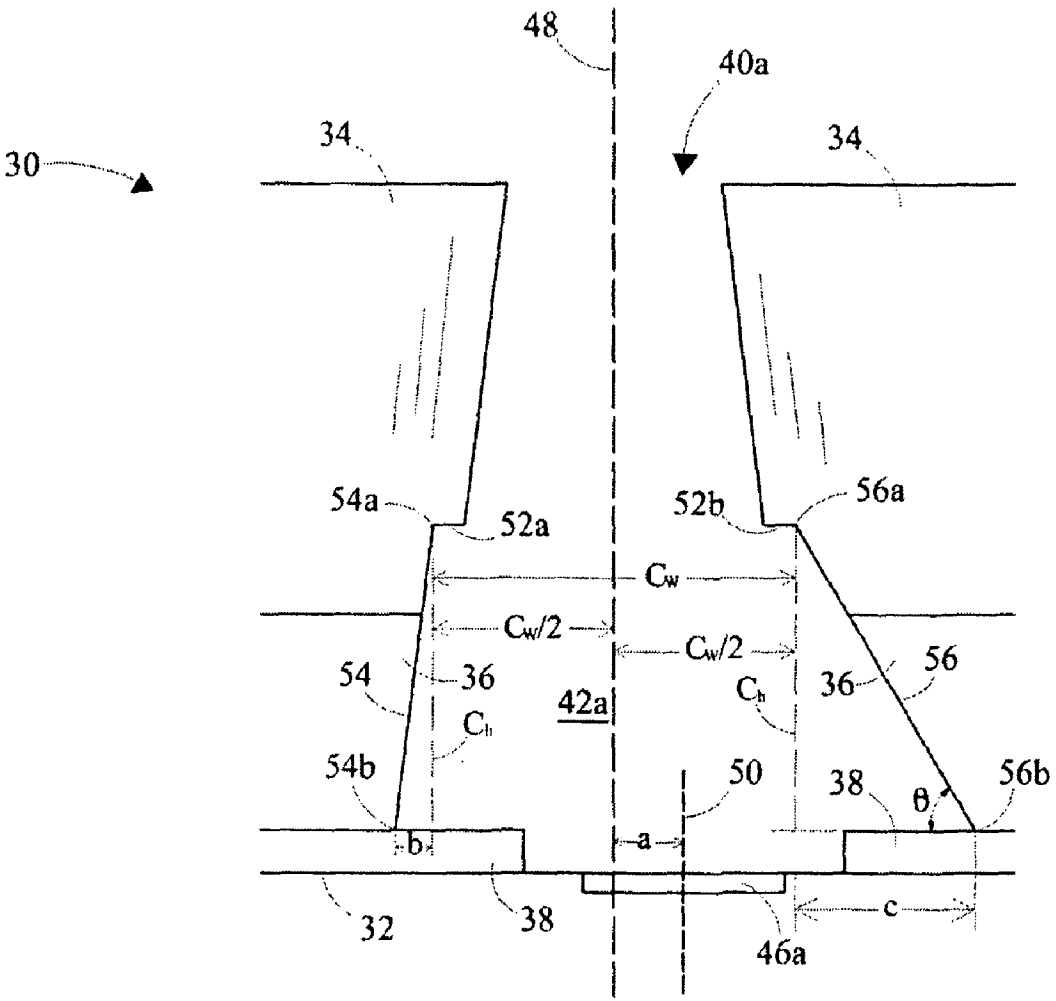
FIG. 3A is a schematic depiction of a cross-sectional view of a nozzle hole of a plurality of nozzle holes of the nozzle plate embodying the present invention.

FIG. 3A depicts nozzle hole 40*a* attached to chip 32 for preparing nozzle plate 30 for bonding to chip 32. It will be evident to those skilled in the art that nozzle hole 40*a* is depicted for exemplary purposes and that the example applies to plurality of nozzle holes 40 for preparing nozzle plate 30 for bonding to chip 32. As explained in conjunction with FIG. 3, the at least a portion of a wall of nozzle hole 40*a* may be laser ablated using the grayscale mask to configure asymmetrical flow-feature for nozzle hole 40*a*, and, central axis 48 of nozzle hole 40*a* may be positioned at a predefined distance from central axis 50 of energizing element 46*a* prior to bonding nozzle plate 30 to chip 32. Nozzle plate 30 may stretch, i.e., expand, during the bonding on account of the thermal processes. Each nozzle hole may no longer be aligned to be centered over corresponding energizing element on account on stretching of nozzle plate 30 during the bonding. Accordingly, the central axis of the each nozzle hole may be aligned at a predefined distance from the central axis of the corresponding energizing element to compensate for stretching of nozzle plate 30 during the bonding, such that the central axis of the each nozzle hole is substantially aligned with the central axis of the corresponding energizing element on the bonding of nozzle plate 30 to chip 32.

The predefined distance for positioning central axis 48 from central axis 50 may be based on one or more dimensions of nozzle plate 30. An average stretch factor for nozzle plates may be determined using formula $$\text{Stretch Factor} = \frac{x}{y}$$

Where x denotes average length of a nozzle plate after manufacture and y denotes average length of the nozzle plate after the TCB process and the bake process. For a given length of nozzle plate 30, a stretch factor may be determined for nozzle plate 30. Central axis 48 of nozzle hole 40*a* may be positioned at a distance 'a' from central axis 50 of energizing element 46*a* to accommodate for expansion of nozzle plate 30 during the bonding. The distance 'a' may be based on the stretch factor of nozzle plate 30 determined using the formula. Nozzle plate 30 may expand during the TCB process and the bake process thereby aligning central axis 50 with central axis 48 to configure a position of nozzle hole 40*a* centered on energizing element 46*a* for achieving desired directionality of the ink droplets.

A location of central axis 48, hereinafter referred to as 'Prestretch Nozzle Center', at distance 'a' from central axis 50 may be used to determine requisite wall angles for configuring asymmetric flow-feature for nozzle hole 40*a*.

In FIGS. 3 and 3A, nozzle holes such as nozzle hole 40*a* include increased wall angles towards a chip-side for configuring ink flow chambers such as ink flow chamber 42*a*. In the cross-sectional view depicted in FIG. 3A, edge portions such as a first edge portion 52*a* and a second edge portion 52*b* serve as transition surfaces for transition from a wall angle at a top portion (not shown) of nozzle hole 40*a* to a wall angle, with increased taper, at the chip-side of nozzle hole 40*a*. Ink flow chamber 42*a* includes an inboard chamber wall 54 (closer to the Prestretch Nozzle Center) and an outboard chamber wall 56 (farther from the Prestretch Nozzle Center as compared to inboard chamber wall 54 and depicted as outboard chamber wall 44 in FIG. 3). Inboard chamber wall 54 and outboard chamber wall 56 extend from edge portions 52*a* and 52*b* respectively in nozzle hole 40*a* to planarizing layer 38 on chip 32. Inboard chamber wall 54 includes a first end-portion towards first edge portion 52*a* and hereinafter referred to as inboard first end 54*a*, and a second end-portion towards the chip-side and hereinafter referred to as inboard second end 54*b*. Outboard chamber wall 56 similarly includes an outboard first end 56*a* and an outboard second end 56*b* configuring end-portions of outboard chamber wall 56 towards second edge portion 52*b* and the chip-side of outboard chamber wall 56, respectively. A distance between inboard first end 54*a* and outboard first end 56*a* may be referred to as 'chamber width' and may be denoted by '$C_w$'. It will be evident to those skilled in the art that a distance from the Prestretch Nozzle Center to inboard first end 54*a* may be equal to a distance from the Prestretch Nozzle Center to outboard first end 56*a* and may be equal to '$C_w/2$'.

A perpendicular projection from inboard first end 54*a* to planarizing layer 38 may configure a 'channel height' of ink flow chamber 42*a* and may be denoted by '$C_h$'. A horizontal distance from inboard second end 54*b* to the perpendicular projection from inboard first end 54*a* may be referred to as 'inboard chamber taper' and may be denoted by 'b'. Similarly, a horizontal distance from outboard second end 56*b* to the perpendicular projection from outboard first end 56*a* onto planarizing layer 38 may be referred to as 'outboard chamber taper' and may be denoted by 'c'. A distance, hereinafter referred to as $GAP_{inboard}$, of inboard second end 54*b* from central axis 50, may be obtained as:

$$GAP_{inboard} = b + \frac{Cw}{2} + a$$

A distance of outboard second end 56*b* from central axis 50, hereinafter referred to as $GAP_{outboard}$, may be obtained as:

$$GAP_{outboard} = c + \frac{Cw}{2} - a$$

To obtain the desired substantially symmetrical, post-bonding flow-feature of nozzle hole 40, the $GAP_{inboard}$ should be approximately equal $GAP_{outboard}$, such that central axis 48 is coincidental with central axis 50 and wall angles of inboard chamber wall 54 and outboard chamber wall 56, are symmetrical about central axis 48.

Thus, on equating $GAP_{inboard}=GAP_{outboard}$, the following relation is obtained:

$$c=b+2a$$

For a given value of inboard chamber taper 'b' and value of 'a' determined using stretch factor for nozzle plate 30, outboard chamber taper 'c' may be determined. Further, using techniques known in the art, channel height '$C_h$' may be obtained. Channel height '$C_h$' may be used to obtain a wall angle 'θ', subtended by outboard chamber wall 56 with planarizing layer 38, i.e., with chip 32, using formula:

$$\theta = \tan^{-1}\left(\frac{C_h}{c}\right)$$

Values of wall angle 'θ' and outboard chamber taper 'b' may then be used to laser ablate a portion of the wall, i.e., outboard chamber wall 56, for obtaining desired increased wall angle for configuring asymmetrical flow-feature for nozzle hole 40*a*. On configuring the asymmetrical flow-features for each nozzle hole of plurality of nozzle holes 40 and aligning nozzle plate 30 such that central axis of each nozzle hole is at a distance 'a' from central axis of an energizing element corresponding to the each nozzle hole, nozzle plate 30 may then be bonded to chip 32 using the thermal processes.

It will be evident to those skilled in the art that the example explained in conjunction with FIG. 3A is described for exemplary purposes, and that nozzle plate 30 may be prepared, i.e., the asymmetrical flow-feature for the each nozzle hole of the plurality of nozzle holes 40 may be configured using different techniques for improving a post-bonding symmetry. An improved post-bonding symmetry, i.e., a substantially symmetrical flow-feature for the each nozzle hole, of nozzle plate 30 for nozzle holes, such as nozzle hole 40*a* is depicted in FIG. 4.

Figure 4:
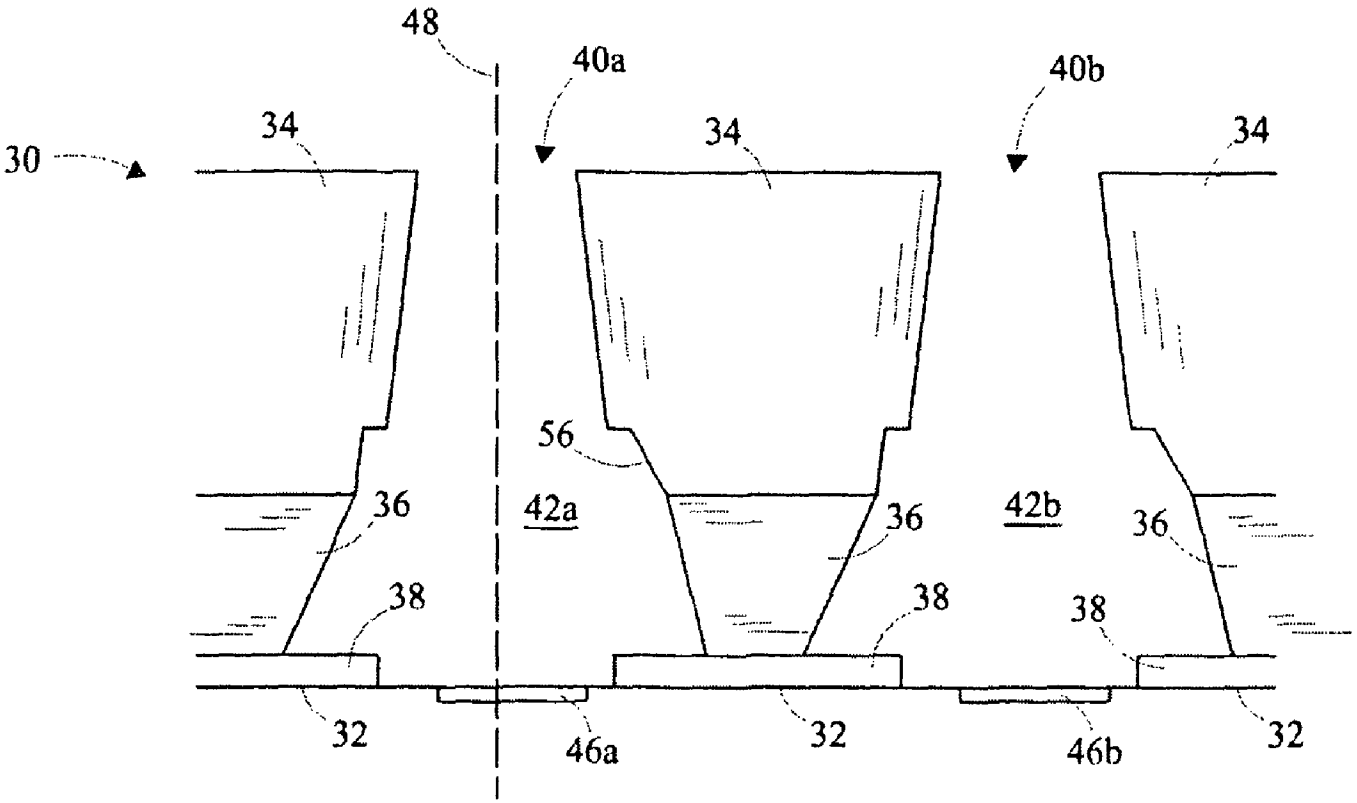
FIG. 4 is a schematic depiction of a cross-sectional view of a portion of the nozzle plate of FIG. 3, bonded to the chip.

FIG. 4 is a schematic depiction of a cross-sectional view of a portion of nozzle plate 30 bonded to chip 32. As explained in conjunction with FIGS. 3 and 3A, each nozzle hole of plurality of nozzle holes 40 may be configured with asymmetrical flow-features using laser ablation with the grayscale mask, and further attached to chip 32 such that the central axis of each nozzle hole is aligned at a predefined distance from the central axis of respective energizing element, prior to bonding nozzle plate 30 to chip 32. Nozzle plate 30 may be prepared with asymmetrical flow-features for plurality of nozzle holes 40, which compensates for at least some of the deformation that occurs during bonding. During the thermal processes, substrate layer 34 of nozzle plate 30 and chip 32 expand to varying degrees, and adhesive layer 36 attached to substrate layer 34 and chip 32 expands to conform to the varying degrees of expansion.

As depicted in FIG. 4, outboard chamber walls of nozzle holes, such as outboard chamber wall 56 of nozzle hole 40*a*, expand on account of expansion of adhesive layer 36 to conform to expansion in substrate layer 34 and chip 32. Expansion of outboard chamber wall displaces an energizing element such that the central axis of the energizing element such as energizing element 46*a* is substantially coincidental with central axis of respective nozzle hole such as nozzle hole 40*a*. Moreover, the expansion of outboard chamber wall 56 configures a substantially symmetrical flow-feature structure along a central axis of nozzle hole and moreso, centered over energizing element. Thus, ablating at least a portion of a wall of the each nozzle hole to create asymmetrical flow-features, prior to the bonding of the nozzle plate to the chip, results in improved post-bonding symmetry of nozzle plate 30.

Nozzle plate 30 as prepared herein includes asymmetric flow-features for each of plurality of nozzle holes 40 perforated in nozzle plate 30. Furthermore, nozzle plate 30 is disposed such that the central axis of the each nozzle hole is aligned at a predefined distance from the central axis of the energizing element associated with the each nozzle hole. The asymmetric flow-features and the alignment of the nozzle plate 30 compensate for the deformation, i.e., stretching of the nozzle plate 30 during the bonding of nozzle plate 30 to chip 32. Further, a post-bonding symmetry of the each nozzle hole is improved, i.e., a portion of wall on either side of the central axis of the each nozzle hole are substantially symmetrical and moreso, the each nozzle hole is substantially centered on the corresponding energizing element. The improved post-bonding symmetry improves a directionality of ink droplets ejected from the each nozzle hole. Furthermore, a swath area expansion resulting from deformation caused to nozzle plate 30 during bonding process is substantially reduced.

The foregoing description of several methods and an embodiment of the present invention have been presented for purposes of illustration. It is not intended to be exhaustive or to limit the present invention to the precise steps and/or forms disclosed, and obviously many modifications and variations are possible in light of the above description. It is intended that the scope of the present invention be defined by the claims appended hereto

What is claimed is:

1. A nozzle plate structure adapted for bonding to a heater chip to create an ink jet print head, the nozzle plate structure having a substrate layer and an adhesive layer, the nozzle plate structure comprising:

a plurality of nozzle holes disposed in said nozzle plate, each of said plurality of holes associated with a corresponding one of a plurality of heater elements disposed in said chip; and an ink flow chamber associated with each of said plurality of nozzle holes, said ink flow chamber extending through said substrate and said adhesive layers such that each of said nozzle holes is in fluid communication with said corresponding heater element;

wherein said ink flow chamber includes a wall that extends generally conically from a nozzle hole opening in said substrate layer to a wider opening in said adhesive layer; and wherein further said wall is asymmetrical such that the substrate layer and the adhesive layer each define a portion of an inboard chamber wall and an outboard chamber wall of the ink flow chamber and the inboard chamber wall and the outboard chamber wall extend from the heater chip to the nozzle hole opening at differing wall angles and the portion of the inboard chamber wall in both the substrate layer and the adhesive layer parallel one another as do the portion of the outboard chamber wall in both the substrate layer and adhesive layer parallel one another.

2. The nozzle plate of claim 1, wherein one side of said conical wall has an increased taper compared to a wall taper on an opposite side of the conical wall.

3. The nozzle plate of claim 1, wherein a central axis of each of said plurality of nozzle holes is offset from a central axis of each corresponding heater element by a predefined distance that can be represented as distance 'a'.

4. The nozzle plate of claim 3, wherein said predefined distance is based at least in part on an amount of deformation of said ink flow chamber that occurs when said nozzle plate structure is bonded to said heater chip.

5. The nozzle plate of claim 3, wherein said predefined distance is based at least in part on a first relationship between a first length of said nozzle plate structure before said nozzle plate structure has been bonded to said heater chip and a second relationship between a second length of said nozzle plate structure after said nozzle plate structure has been bonded to said heater chip.

6. The nozzle plate of claim 3, wherein said ink flow chamber comprises first and second edge portions that extend away from said conical wall, said first and second edge portions serving as transition surfaces for a transition from a wall angle at a top portion of said nozzle hole opening in said substrate layer to a wall angle with an increased taper at a chip-side of said nozzle hole.

7. The nozzle plate of claim 6, wherein said inboard chamber wall has first and second ends, said inboard first end toward said substrate layer, said second inboard end toward said heater chip; wherein further said outboard chamber wall has first and second ends, said outboard first end towards said substrate layer, said outboard second end toward said heater chip.

8. The nozzle plate of claim 7, wherein a distance between said inboard first end and said outboard first end represents a chamber width, $C_w$, and a center point in said chamber width is equidistant between said inboard first end and said outboard first end, having a distance equal to $C_w/2$.

9. The nozzle plate of claim 8, wherein a first perpendicular projection from said inboard first end to a planarizing layer associated with said heater chip represents a channel height, $C_h$; wherein further a horizontal distance from said inboard second end to said first perpendicular projection represents an inboard chamber taper having a distance 'b'; wherein further a horizontal distance from said second outboard second end to a second perpendicular projection from said outboard first end to said planarizing layer represents an outboard chamber taper having a distance 'c.

10. The nozzle plate of claim 9, wherein a distance between said inboard second end from said central axis is represented as $GAP_{inboard}$ and can be calculated as:

$$GAP_{inboard} = b + \frac{Cw}{2} + a.$$

11. The nozzle plate of claim 10, wherein a distance between said outboard second end from said central axis is represented as $GAP_{outboard}$ and can be calculated as:

$$GAP_{outboard} = c + \frac{Cw}{2} - a.$$

12. The nozzle plate of claim 11, wherein a wall angle 'θ' subtended by said outboard chamber wall with said planarizing layer can be calculated as:

$$\theta = \tan^{-1}\left(\frac{C_h}{c}\right).$$

* * * * *